US005189788A

United States Patent [19]

Sakai et al.

[11] Patent Number: 5,189,788

[45] Date of Patent: Mar. 2, 1993

[54] METAL TERMINAL LOCKING METHOD AND DEVICE

[75] Inventors: Hitoshi Sakai; Toshihiko Masuda, both of Shizuoka, Japan

[73] Assignee: Yazaki Corporation, Tokyo, Japan

[21] Appl. No.: 752,797

[22] Filed: Aug. 30, 1991

[30] Foreign Application Priority Data

Sep. 3, 1990 [JP] Japan ..... 2-230654

[51] Int. Cl.[5] ..... H01R 9/00

[52] U.S. Cl. ..... 29/842; 29/748

[58] Field of Search ..... 29/842, 857, 884, 747, 29/748, 758

[56] References Cited

U.S. PATENT DOCUMENTS 4,260,209 4/1981 Zell et al. ..... 29/842 X 4,946,399 8/1990 Kawashima ..... 29/842 X

*Primary Examiner*—Timothy V. Eley

*Attorney, Agent, or Firm*—Sughrue, Mion, Zinn, Macpeak & Seas

[57] ABSTRACT

In locking metal terminals in a connector, a terminal locking jig having engaging prongs which are extended respectively so as to be engaged with terminal accommodating chambers in the rear end portion of a connector housing is inserted into a terminal-locking-member accommodating chamber formed surrounding the terminal accommodating chambers, to drive the metal terminals which are not completely locked yet to the positions where the metal terminals are completely locked, and thereafter a terminal locking element having engaging prongs which are extended in the same manner is inserted into the connector housing from the rear or side. Thus, the terminal locking member can be engaged with the connector housing with ease.

10 Claims, 4 Drawing Sheets

METAL TERMINAL LOCKING METHOD AND DEVICE

BACKGROUND OF THE INVENTION

This invention relates to a method of locking metal terminals in a connector used for connecting, for instance, harnesses in a motor vehicle, and a device for practicing the method (hereinafter referred to as "a terminal locking method", and "a terminal locking device", respectively, when applicable).

An example of a conventional terminal locking device of this type, as shown in FIG. 8, is of 4-pole type; and comprises: a housing a; and a terminal locking element b. The terminal locking element b is E-shaped; that is, it comprises; a common base segment $b_1$; and three lateral segments $b_2$, $b_3$ and $b_4$ extended from the common base segment in the same direction. More specifically, the two lateral segments $b_3$ and $b_4$ are extended from both ends of the base segment $b_1$, and the remaining lateral segment $b_2$ is extended from the middle of the base segment so as to define two wire accommodating grooves $c_1$ and $c_4$ with the lateral segments $b_3$ and $b_4$. The lateral segments $b_2$ through $b_4$ have engaging protrusions $b_5$ at the ends, respectively, and the common base segment $b_1$ has a locking arm $b_6$.

The terminal locking device is used as follows:

As shown in FIG. 9, for instance four metal terminals e connected to four electrical wires d are inserted and locked in terminal accommodating chambers $a_1$ in advance. The electrical wires d inserted into the wire accommodating grooves $c_1$ and $c_2$ of the terminal locking element b, respectively. Under this condition, the terminal locking element b is pushed into an accommodating chamber $a_2$ while being held inclined with the engaging protrusion $b_5$ down, until the engaging protrusions are engaged with locking holes $a_3$, respectively. Under this condition, the opposite end of the terminal locking element b is depressed until the locking arm $b_6$ is engaged with a locking hole $a_4$.

As was described above, the terminal locking element b is engaged with the accommodating chamber $a_2$ from behind the housing a. It takes time to remove the terminal locking element from the housing.

The terminal locking element which is provided in addition to the connector housing, and is engaged with the connector housing from behind is a secondary locking means which is used to increase the terminal holding force, and to prevent the loose engagement of the terminals. Therefore, if a sufficient terminal holding force can be obtained by the primary locking of the connector housing, then all that is necessary for the terminal locking element is to prevent the loose engagement of the terminals.

On the other hand, there is a tendency for connectors to increase the number of poles. Therefore, a relatively great force is required for engaging the terminal locking element with the connector housing while driving a number of metal terminals forward which are not completely engaged with the housing.

SUMMARY OF THE INVENTION

Accordingly, an object of the invention is to provide a method of locking terminals in a connector in which the above-described difficulties accompanying a convention method of locking terminals in a connector have been eliminated, and a device for practicing the method.

The foregoing object and other objects of the invention have been achieved by the provision of:

a method of locking metal terminals in a connector, in which, according to the invention, a terminal locking jig having a plurality of engaging prongs which are extended respectively along a plurality of terminal accommodating chambers in the rear end portion of a connector housing is inserted into a terminal-locking-member accommodating chamber formed surrounding the plurality of terminal accommodating chambers, to drive the metal terminals which are not completely locked yet to positions where the metal terminals are completely locked, and thereafter a terminal locking element having engaging prongs which are equal in number to the prongs of the terminal locking jib and are extended in the same manner is inserted into the connector housing from the rear or side, and a device for locking metal terminals in a connector which, according to the invention, comprises: a connector housing including a plurality of terminal accommodating chambers; and a terminal locking member which is detachably coupled to the rear end portion of the connector housing, the rear end portion of the connector housing including a terminal-locking-member accommodating chamber formed with a surrounding wall in such a manner that the terminal-locking-member accommodating chamber is opened rearward, the surrounding wall having locking portions for locking the terminal locking member on one side thereof, and a slot on the other side, the terminal locking member comprising: a base portion; engaging prongs extended from the base portion so as to engage with metal terminals, and having engaging portions at the ends so as to engaged with the locking portions.

The nature, utility and principle of the invention will be more clearly understood from the following detailed description and the appended claims when read in conjunction with the accompanying drawings.

DETAILED DESCRIPTION OF THE INVENTION

One preferred embodiment of this invention will be described with reference to the accompanying drawings.

Figure 1:
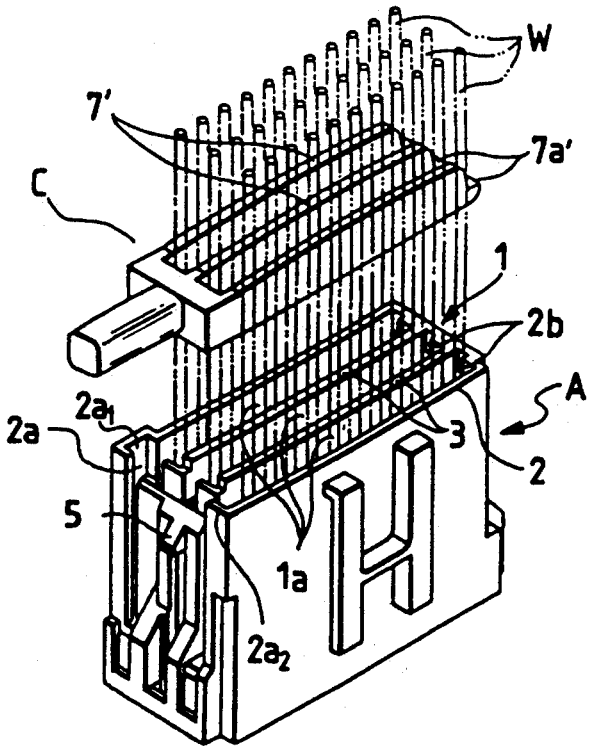
FIG. 1 is an exploded perspective view showing a connector housing and a terminal locking jig in one example of a device for locking metal terminals in a connector according to this invention.
Figure 3:
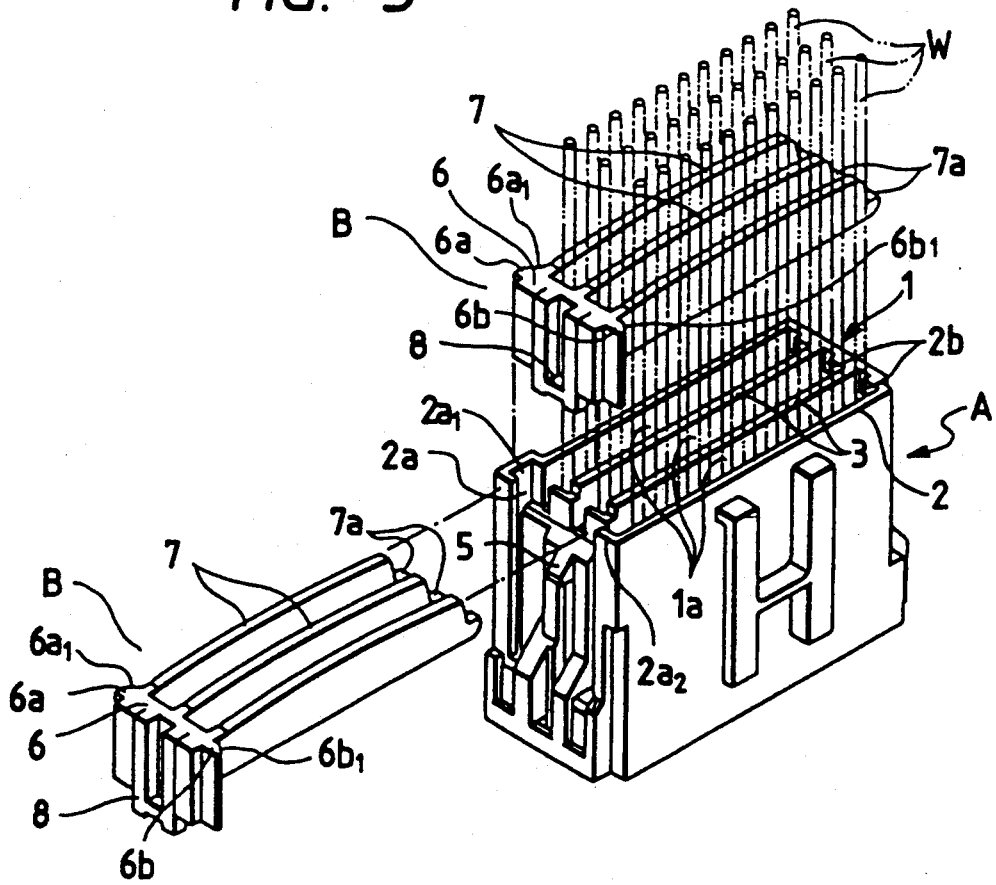
FIG. 3 is a perspective view showing the connector housing and a terminal locking element which is to be engaged with the connector housing.

In FIGS. 1 and 3, reference character A designates a connector housing of synthetic resin; B, a terminal locking element of synthetic resin; and C, a terminal locking jig of metal.

Figure 5:
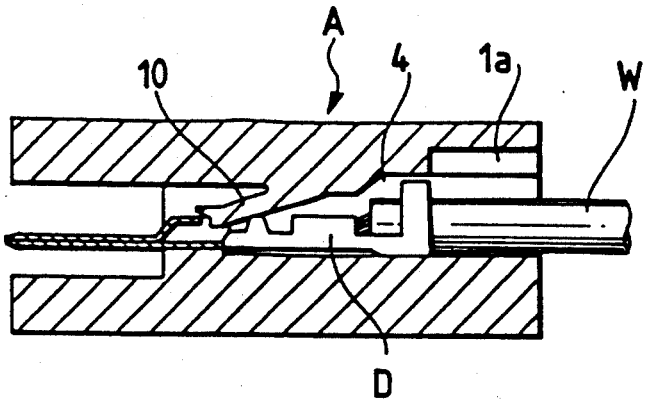
FIG. 5 is a sectional view showing a metal terminal which has been completely inserted in a terminal accommodating chamber in the connector housing.

The connector housing A has a surrounding wall 2, which defines an accommodating chamber 1 for accommodating the terminal locking element B and the terminal locking jig C (hereinafter referred to as "terminal locking members B and C", when applicable). The accommodating chamber 1 is divided by partition walls 3 into elongated sub-chambers 1*a*. In each sub-chamber 1*a*, a plurality of terminal accommodating chambers 4 (as shown in FIG. 5) are arranged longitudinally.

A slot 2*a* is formed in the part of the surrounding wall 2 that is one end of the accommodating chamber 1 in the longitudinal direction. The slot 2*a* thus formed has a supporting groove $2a_1$ and a supporting wall $2a_2$ on its both sides. The sub-chambers la include locking portions 2*b* on the sides opposite to the slot 2*a*.

A locking protrusion 5 is formed on the outer surface of the part of the surrounding wall 2 that includes the slot 2*a*, so as to meet the terminal locking element B.

The terminal locking element B is in the form of a fork; more specifically, it comprises: a base portion 6 including a fitting portion 6*a* which is engaged with the supporting groove 2*a* and an engaging portion 6*b* which is engaged with the supporting wall 2*a*; and three engaging prongs 7 extended from the base portion 6 in the same direction so as to be engaged with the sub-chambers 1*a*. The engaging prongs 7 have locking protrusions 7*a* at the free ends. The base portion 6 has an engaging portion on the other side which is provided for the aforementioned locking protrusion 5.

The terminal locking jig C is also in the form of a fork; more specifically, it comprises a base portion 6'; and three engaging prongs 7' which are extended from the base portion 6' in the same direction so as to be engaged with the sub-chambers 1*a*. The engaging prongs 7, have locking protrusions 7*a'* at the free ends. The base portion 6' has an operating rod 9 on the other side.

Figure 6:
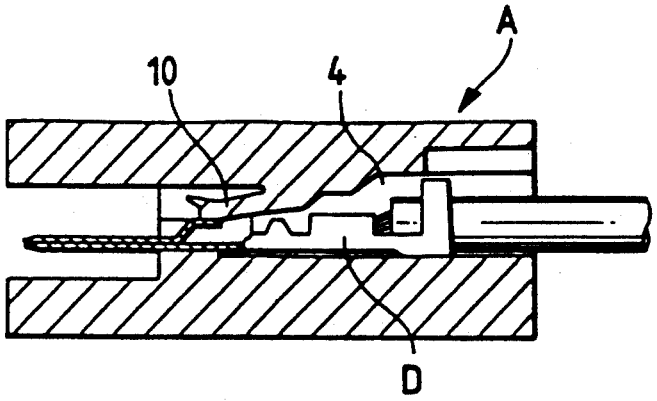
FIG. 6 is a sectional view showing the metal terminal which has been incompletely inserted in the terminal accommodating chamber.

In each terminal accommodating chamber 4, a metal terminal D connected to an electrical wire W is primarily looked with a flexible locking piece 10 as shown in FIG. 5; however, it is not completely locked with the flexible locking piece 10 as shown in FIG. 6.

Figure 2:
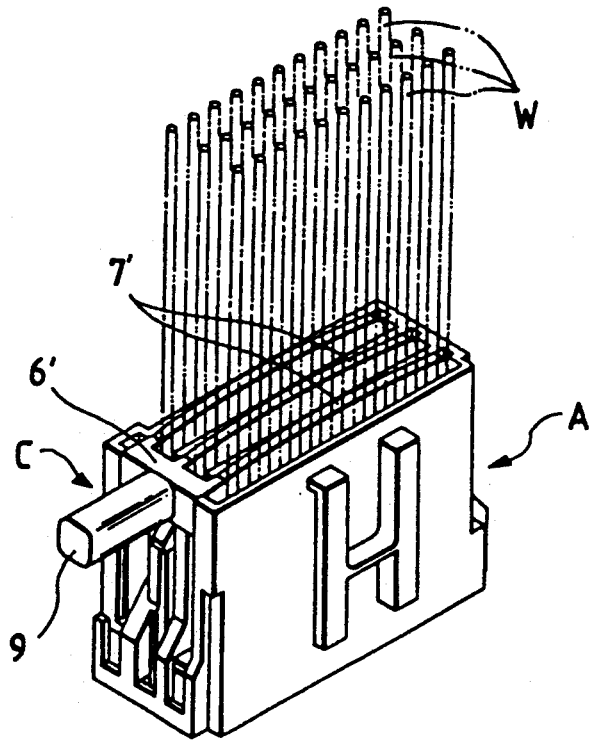
FIG. 2 is a perspective view showing the connector housing with the terminal locking jig inserted in it.
Figure 7:
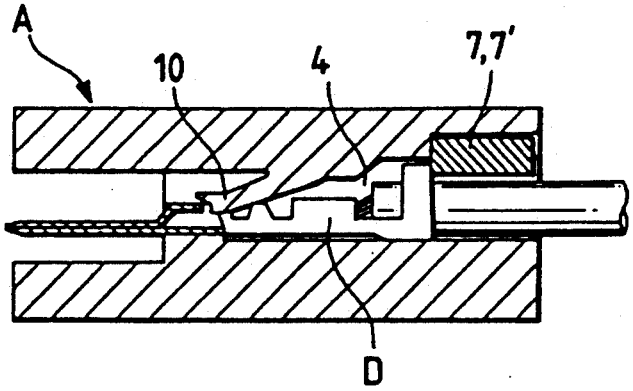
FIG. 7 is a sectional view showing the metal terminal with the terminal locking member.
Figure 8:
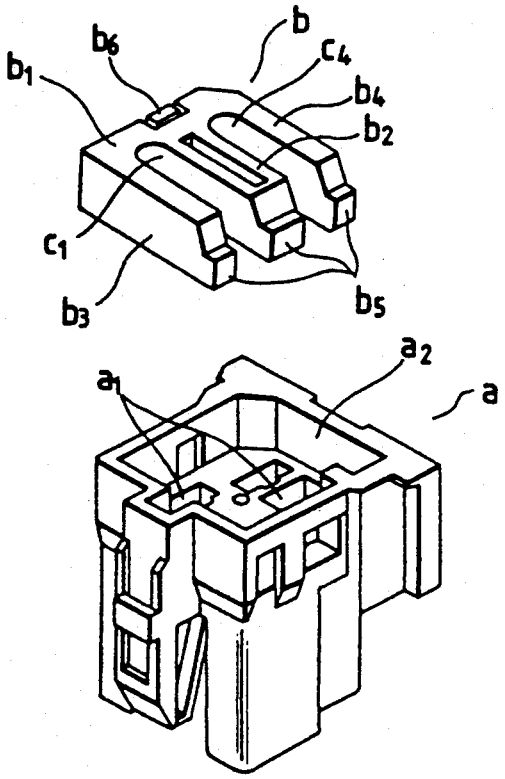
FIG. 8 PRIOR ART
FIG. 8 is an exploded perspective view showing a conventional metal terminal locking device.
Figure 9:
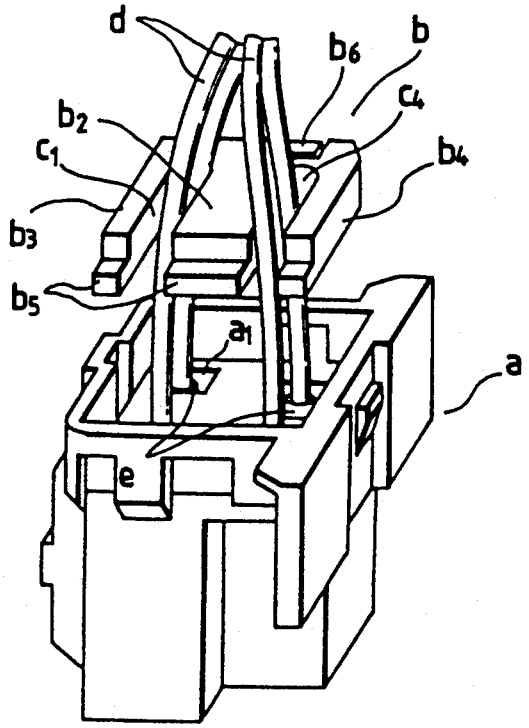
FIG. 9 PRIOR ART
FIGS. 9 and 10 are a perspective view and a sectional view, respectively, for a description of a metal terminal locking operation with the conventional metal terminal locking device.
Figure 10:
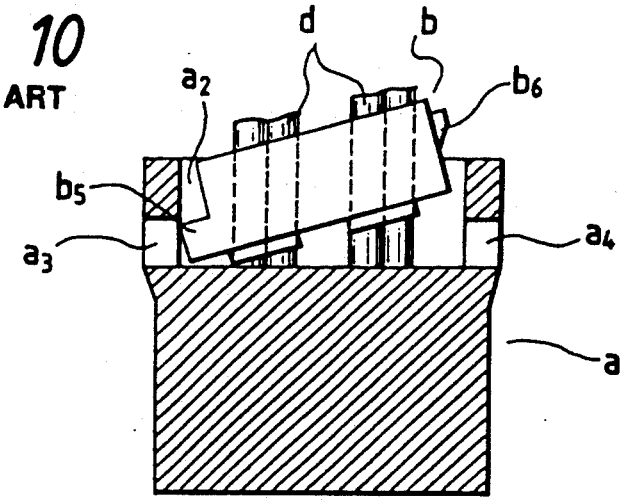
FIG. 10 PRIOR ART

When the metal terminals are held as shown in FIG. 5, o the terminal locking jig C is inserted into the accommodating chamber 1 of the terminal locking members from behind by turning its operating rod 9 with the locking protrusions 7*a*, engaged with the locking portion 1*b* as shown in FIG. 2. As a result, the engaging prongs 7' are engaged with the metal terminals D which are not completed locked yet, to move the metal terminals D forwards, whereby the metal terminals are primarily locked by the movable locking pieces 10 as shown in FIG. 7.

Thereafter, the terminal locking element B is connected to the connector housing B.

Figure 4:
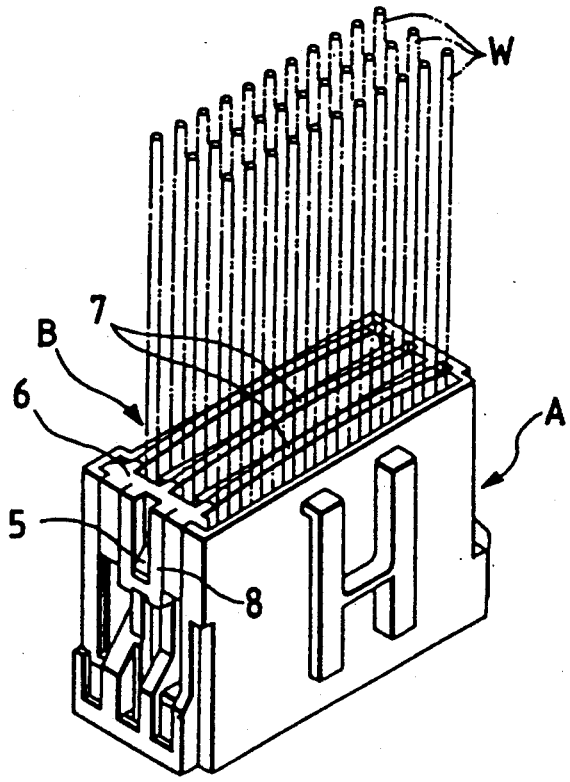
FIG. 4 is a perspective view showing the connector housing engaged with the terminal locking element.

As shown in FIG. 3, the terminal locking element B can be inserted into the accommodating chamber 1 from the rear or side. In both cases, the locking protrusions 7*a* of the locking prongs 7 are engaged with the locking portions 2*b* while the base portion 6 is engaged with the slot 2*a*, and the engaging portion 8 is engaged with the locking protrusion 5 on the connector housing A, as shown in FIG. 4.

The inner surfaces of the fitting portion 6*a* and the engaging portion 6*b* of the base portion 6 are formed into tapered guides $6a_1$ and $6b_1$. Owing to those tapered guides, when the terminal locking element B is inserted into the accommodating chamber 1 from the side, the fitting portion 6*a* and the engaging portion 6*b* are moved in to engagement with the supporting groove $2a_1$ and the supporting wall $2a_2$.

As was described above, in the metal terminal locking method of the invention, the terminal locking jig having the locking prongs extended respectively along the terminal accommodating chambers in the rear end portion of the connector housing is inserted into the terminal-locking member accommodating chamber formed surround the terminal accommodating chamber, to drive the metal terminal which are not completed locked yet to the positions where the metal terminal are completely locked. Under this condition, the terminal locking element having the prongs which are equal in number to the aforementioned prongs of the terminal locking jib and are extended in the same manner is inserted into the connector housing from the rear or side. On the other hand, the metal terminal locking device of the invention comprises: the connector housing including a plurality of terminal accommodating chamber; and the terminal locking member which is detachably coupled to the rear end portion of the connector housing. The rear end portion of the connector housing includes the terminal-locking-member accommodating chamber formed with the surrounding wall in such a manner that the terminal-locking-member accommodating chamber is opened rearward. The surrounding wall has the locking portion for locking the terminal locking member on one side, and the slot on the other side. The terminal locking member comprises: the base portion; the engaging prongs extended from the base portion so as to engage with the metal terminals, have the engaging portions at the ends so as to engage with the locking portions. Hence, the terminal locking member can be engaged with the connector housing with ease.

While there has been described in connection with the preferred embodiment of the invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A method of locking metal terminals in a connector including a connector housing having a terminal locking member accommodating chamber disposed adjacent a plurality of terminal accommodating chambers in which said metal terminals are respectively disposed, said connector further including a terminal locking member for locking each of said metal terminals in said terminal accommodating chambers when said terminals are moved in an insertion direction to a predetermined position, comprising the steps of:

providing a terminal locking jig including at least one engaging prong extending therefrom;

inserting said terminal locking jig into said terminal-locking-member accommodating chamber;

moving said locking jig in said insertion direction so as to attendantly move said metal terminals, which are not in said predetermined position, to said predetermined position such that said terminals are locked by said locking members;

removing said locking jig; and inserting a terminal locking element into said locking member accommodating chamber so as to secondarily lock said terminals in said terminal accommodating chambers.

2. The method of locking metal terminals according to claim 1, wherein said terminal locking jig includes:

a plurality of engaging prongs which are extended respectively along said terminal accommodating chambers in the rear portion of said connector housing.

3. The method of locking metal terminals according to claim 1, wherein said terminal locking element includes:

a plurality of engaging prongs which are extended respectively along said terminal accommodating chambers.

4. An apparatus for locking metal terminals in a connector which comprises:

a connector housing including a plurality of terminal accommodating chambers; and a terminal locking member which is detachably coupled to a rear end portion of said connector housing, said rear end portion of said connector housing including a terminal locking-member accommodating chamber formed with a surrounding wall in such a manner that said terminal-locking-member according chamber is opened in a rearward direction, said surrounding wall having locking portions for locking said terminal locking member on one side thereof, and a slot on the other side, said terminal locking member comprising:

a base portion;

engaging prongs extended from said base portion so as to be engaged with the metal terminals, and having engaging portions at the ends so as to be engaged with said locking portions, wherein said terminal locking member is insertable into said locking member accommodating chamber through said rear end portion or through said slot.

5. An apparatus for locking metal terminals in a connector, comprising:

a connector housing having a surrounding wall and a terminal-locking-member accommodating chamber defined by said surrounding wall and formed surrounding a plurality of terminal accommodating chambers; and a terminal-locking-member which is detachably coupled to said connector housing;

wherein said surrounding wall includes locking portions on one side thereof, and a slot portion on an other side, and said terminal locking member includes:

a base member; and engaging prongs extended from one side of said base member so as to be engaged with the metal terminals, said engaging prongs having first engaging portions at distal ends thereof so as to be engaged with said locking portions of said surrounding wall therein said terminal locking member is insertable into said locking-member accommodating chamber through said rear end portion or through said slot portion.

6. The apparatus for locking metal terminals according to claim 5, wherein said terminal-locking-member accommodating chamber is formed with a surrounding wall in such a manner that said terminal-locking-member accommodating chamber is opened rearward.

7. The apparatus for locking metal terminals according to claim 5, wherein said terminal-locking-member accommodating chamber is divided by partition walls into sub-chambers and said terminal accommodating chambers are arranged longitudinally in each of said sub-chambers.

8. The apparatus for locking metal terminals according to claim 5, wherein said slot portion has a supporting groove and a supporting wall on opposite sides thereof, said base member including a fitting portion which is engaged with said supporting groove and a second engaging portion which is engaged with said supporting wall.

9. The apparatus for locking metal terminals according to claim 8, wherein said base member further includes a third engaging portion extending therefrom, and a locking protrusion is provided to an outside of said surrounding wall so as to be engaged with said third engaging portion.

10. The apparatus for locking metal terminals according to claim 5, further comprising a locking jig having a plurality of jig engaging prongs extending therefrom corresponding in number to said plurality of engaging prongs of said terminal locking member, said locking jig being insertable into said accommodating chamber so as to urge said metal terminals into a locked position in said housing and being removable to allow for subsequent insertion of said locking member.

* * * * *